US010769879B2

(12) United States Patent
Müller

(10) Patent No.: US 10,769,879 B2
(45) Date of Patent: Sep. 8, 2020

(54) DEVICE AND METHOD FOR SEPARATING VALUE DOCUMENTS, IN PARTICULAR BANKNOTES, AND VALUE DOCUMENT PROCESSING SYSTEM

(71) Applicant: GIESECKE+DEVRIENT CURRENCY TECHNOLOGY GMBH, Munich (DE)

(72) Inventor: Julian Müller, Poing (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 16/301,801

(22) PCT Filed: May 12, 2017

(86) PCT No.: PCT/EP2017/000582

§ 371 (c)(1),
(2) Date: Nov. 15, 2018

(87) PCT Pub. No.: WO2017/198329

PCT Pub. Date: Nov. 23, 2017

(65) Prior Publication Data

US 2019/0164376 A1 May 30, 2019

(30) Foreign Application Priority Data

May 17, 2016 (DE) ..... 10 2016 006 016

(51) Int. Cl.
*B65H 3/52* (2006.01)
*B65H 3/48* (2006.01)
*G07D 11/50* (2019.01)

(52) U.S. Cl.
CPC ..... *G07D 11/50* (2019.01); *B65H 3/48* (2013.01); *B65H 3/523* (2013.01); *B65H 3/5276* (2013.01);
(Continued)

(58) Field of Classification Search
CPC ..... G07D 11/50; B65H 3/48; B65H 3/523; B65H 3/5276; B65H 3/5284; B65H 2515/30
(Continued)

(56) References Cited

U.S. PATENT DOCUMENTS 4,482,057 A * 11/1984 Shawen ..... B65H 29/58 209/534
6,648,761 B1 11/2003 Izawa et al.
(Continued)

FOREIGN PATENT DOCUMENTS

DE 10105521 A1 8/2002
DE 69904963 T2 11/2003
(Continued)

OTHER PUBLICATIONS

International Search Report from PCT Application No. PCT/EP2017/000582, dated Sep. 26, 2017.
(Continued)

*Primary Examiner* — Terrell H Matthews
(74) *Attorney, Agent, or Firm* — Workman Nydegger

(57) ABSTRACT

An apparatus and a corresponding method for singling value documents includes: an input device which is devised for receiving a stack of value documents, a transport device which is devised for drawing a value document from a stack of value documents located in the input device, and a transport element, which is devised to influence the drawing of the value document from the stack of value documents. At least one sensor is provided which is devised to capture a size of the stack located in the input device, in particular a height of the stack and/or a fill level of the input device, and a density of the stack. A control device is devised to control the transport device and/or the transport element based on the captured size of the stack and/or the captured density of the stack.

9 Claims, 4 Drawing Sheets

(52) U.S. Cl.
CPC ..... *B65H 3/5284* (2013.01); *B65H 2515/30* (2013.01)

(58) Field of Classification Search
USPC ..... 209/534
See application file for complete search history.

(56) References Cited

U.S. PATENT DOCUMENTS

| | | | | |
|---|---|---|---|---|
| 7,201,278 | B2 * | 4/2007 | Werner | G07D 11/40 209/534 |
| 8,582,186 | B2 | 11/2013 | Demmeler | |
| 2003/0038062 | A1 * | 2/2003 | Werner | G07D 11/50 209/534 |
| 2004/0080094 | A1 * | 4/2004 | Dopfer | B65H 3/5284 271/122 |
| 2012/0038956 | A1 | 2/2012 | Demmeler | |

FOREIGN PATENT DOCUMENTS

| | | | | |
|---|---|---|---|---|
| DE | 102009017411 | A1 | 10/2010 | |
| EP | 0535933 | A1 * | 4/1993 | B65H 3/042 |
| EP | 0535933 | A1 | 4/1993 | |
| EP | 2869277 | A1 | 5/2015 | |
| GB | 2217309 | A | 10/1989 | |
| GB | 2217309 | * | 6/1990 | B65H 3/04 |

OTHER PUBLICATIONS

German Search Report from DE Application No. 102016006016.6, dated Aug. 7, 2017.

* cited by examiner

DEVICE AND METHOD FOR SEPARATING VALUE DOCUMENTS, IN PARTICULAR BANKNOTES, AND VALUE DOCUMENT PROCESSING SYSTEM

BACKGROUND

This invention relates to an apparatus and a method for singling value documents, in particular bank notes, as well as a value-document processing system.

Apparatuses and methods for singling value documents, in particular bank notes, are frequently employed in value-document processing systems to draw individual value documents from a supplied stack of value documents and feed them to a further processing, such as an authenticity check and condition check, counting and sorting.

Different attachments to draw value documents from a stack are known, for example with the help of friction wheels or friction rollers, friction bands or by sucking or injecting air. A high reliability upon the singling of the value documents is important to guarantee an automatic processing of the value documents as trouble-free as possible. In particular it is important to avoid multiple drawings, faulty drawings and/or other disturbances, such as a jam of value documents in the singler.

SUMMARY

It is the object of the present invention to state an apparatus and a method for singling value documents, in particular bank notes, as well as a value-document processing system by which a reliable singling of value documents, in particular bank notes, is guaranteed.

The apparatus according to the invention for singling value documents, in particular bank notes, comprises an input device which is devised for receiving a stack by value documents, a transport device which is devised for drawing a value document from the stack of value documents located in the input device, and a transport element which is devised to influence the drawing of the value document from the stack of value documents. Further, at least one sensor is provided which is devised to capture a size of the stack located in the input device, in particular a height of the stack, and/or a fill level of the input device, and a density of the stack. A control device is devised to control the transport device and/or the transport element based on the captured size of the stack and/or the captured density of the stack.

The value-document processing system according to the invention for processing, in particular sorting, counting and/or checking value documents, in particular bank notes, has an apparatus according to the invention for singling value documents.

In the method according to the invention for singling value documents, in particular bank notes, a value document is drawn from a stack of value documents received by an input device, wherein a size of the stack, in particular a height of the stack and/or a fill level of the input device, is captured and a density of the stack is captured, and the drawing of the value document from the stack is controlled based on the captured size of the stack and/or the captured density of the stack.

The invention is based on the approach of capturing the size and the density of a stack of value documents to be singled, in particular bank notes, with a sensor and controlling the drawing of a value document from the stack by means of a transport device and/or a transport element in dependence on the captured size and/or density of the stack or at least one property derived therefrom, such as a weight of the stack and/or the state (the so-called fitness) of the value documents located in the stack. Individual value documents of the stack are drawn by the transport device, for example by frictional forces between the respectively lowermost value document and the transport device, wherein the drawing process can be influenced by the transport element, for example by blocking or releasing a transport path for the value document to be drawn and/or a change of the frictional forces between transport device and value document. In this manner the singling operation can be adapted to properties of the stack or the value documents located therein and be optimized accordingly.

Altogether, the invention therefore allows a particularly reliable singling of a stack of value documents, in particular bank notes.

A capturing of the size of the stack of value documents by a sensor as intended by the invention can be understood as a direct measurement of the size, for example the height, of the stack as well as an indirect determination of a measure for the size, in particular the height, of the stack on the basis of the sensor signals generated by the sensor. If the sensor signals of the sensor represent, for example, a measure for an electrical capacity which depends on the number of the value documents located before the sensor, the number of the value documents in the stack and/or the height of the stack can be derived or at least estimated from the sensor signals.

A capturing of the density of the stack of value documents by a sensor as intended by the invention is preferably to be understood as a determination of a dimensionless measure for the density of the stack on the basis of the sensor signals.

A determination of the weight of the stack of value documents as intended by the invention is preferably to be understood as a determination of a dimensionless measure for the weight. For example, the weight or a measure for the weight of the stack can be established from the captured size of the stack, in particular the height, and the captured density of the stack.

The fill level of the input device as intended by the invention states to what extent the input device is filled with value documents. For example, the fill level can be a, e.g. percentage, value which states which proportion of the input device is filled with value documents relating to a complete filling. The fill level of the input device characterizes, for example, the ratio of the height of the stack located in the input device to the maximum height of a stack which the input device can receive.

In a preferred embodiment, the control device is devised to establish a weight of the stack on the basis of the size and the density of the stack and to control the transport device and/or the transport element based on the established weight of the stack. From the size and the density of the stack, in particular the number of the value documents in the stack can be determined or at least estimated. By the control of the singling process on the basis of the weight or the number derived therefrom of value documents located in the stack, the value documents can be singled with particularly high reliability while at the same time having a simple structure of the apparatus.

Preferably the control device is devised to establish on the basis of the established weight of the stack a measure for the frictional force or forces between the lowermost value document in the stack and the next value document in the stack and/or the floor of the input device, for example of a placement area, and to control the transport device and/or the transport element such that the drawing of the lowermost value document is reliably effected based on the established friction.

In a further preferred embodiment, the control device is devised to establish on the basis of the density of the stack the state of value documents located in the input device and to control the transport device and/or the transport element based on the established state of the value documents. In this connection it is preferably assumed that value documents are in good state, for example new bank notes, largely wrinkle-free, i.e. smooth, and can hence be densely packed, i.e. a stack of such value documents has a high density. Correspondingly, value documents in a poor state, such as for example old or very used bank notes, are crumpled, creased, uneven and/or torn, so that they can be packed less densely, i.e. a stack of such value documents has a lower density.

The frictional force between the respectively lowermost value document to be drawn from the stack and the value document lying thereabove and/or the floor of the input device, for example a supporting surface, depends on the friction coefficient and the normal force of the value-document stack. This normal force results from the mass increasing toward the supporting surface of the stacked value documents and can therefore depend indirectly on the stack height. The friction coefficient results from different value-document properties, such as to the state of the value document. For this purpose there come into consideration, for example, tears, dog-ears, adhesive strips, soiling, folds and/or basic surface condition of the value documents, in particular printed image, safety threads, inspection windows. Hence the drawing of a value document from the stack can be optimized by the consideration of the height and/or density of the stack of value documents, by influencing, for example, the frictional force between value document to be drawn and transport device by a corresponding control of the transport device and/or the transport element.

In a further preferred embodiment the transport device has at least one drawing element which is devised to draw the value document from the stack, and wherein the control device is devised to control the arrangement of the drawing element relative to the stack located in the input device based on the captured size of the stack and/or the captured density of the stack such that the frictional forces occurring between the drawing element and the value document to be drawn are changed. For example, a contact pressure of the drawing element on the lowermost value document can be increased in a high stack, i.e. upon high frictional forces between the lowermost value document of the stack and the following value document and/or the floor of the input device, for example a supporting surface, by displacing the drawing element in the direction of the stack. Correspondingly, the contact pressure of the drawing element on the lowermost value document can be decreased in a low stack, i.e. upon low frictional forces between the lowermost value document of the stack and the following value document and/or the floor of the input device, for example a supporting surface, by displacing the drawing element in a direction opposite the stack, i.e. away from the stack. As a result of this, a particularly reliable drawing of value documents from a stack is guaranteed.

In a further preferred embodiment the at least one drawing element is configured as a friction band, friction wheel or air baffle plate.

A friction band has a large supporting surface, whereby the frictional force between friction band and the lowermost value document in the stack is increased advantageously. Preferably the friction band is mounted displaceable in relation to the stack of value documents received in the input device, so that the contact pressure of the friction band can be simply adjusted to the lowermost value document in the stack, in particular in dependence on the height and/or density of the stack.

The friction band is preferably devised to periodically protrude or extend into the input device with at least one portion, wherein upon each protruding or extending of the portion of the friction band into the input device a, in particular frictional, contact between the protruding portion of the friction band and the respectively lowermost value document of the stack is produced, so that the respectively lowermost value document of the stack is drawn. Preferably the control device is devised to displace the friction band relative to the stack received by the input device such that the friction band periodically protrudes or extends deeper or less deep into the input device, in particular in dependence on the size and/or density of the stack. Thereby the frictional force between the lowermost value document of the stack and the friction band can be adjusted particularly reliably and so a reliable drawing of the lowermost value document of the stack be guaranteed.

The friction wheel is preferably configured as a roller which is brought in frictional contact with the value document to be drawn and draws the lowermost value document from the stack under rotation. Thereby the singling of value documents from the stack is attained by a particularly simple mechanical construction, which increases the reliability of the apparatus for drawing value documents.

Further, the transport device preferably has a supporting surface for the value documents. Particularly preferably, the control device is configured to change the incline of the supporting surface and thus to increase or to decrease the frictional force between the value document to be drawn and the friction wheel, so that a secure drawing of individual value documents is guaranteed because with stronger incline of the contact surface, a slope descending force acts on the lowermost value document of the stack, preferably in the direction of the friction wheel.

In one embodiment, the floor, or at least a part of the floor, of the input device forms a part of the transport device, in particular the supporting surface for the value documents. Preferably, the control device is configured to change the incline of the floor, or at least a part of the floor, of the input device based on the established size and/or density of the stack of value documents.

The air baffle plate is preferably configured as an even plate having holes, in particular nozzles, and is devised to draw the lowermost value document of the stack from the stack by sucking or blowing off with air. Preferably, the control device is devised to control the strength of the air flow through the holes, in particular nozzles, in dependence on the size and/or the density of the stack.

In a further preferred embodiment the control device is devised to control the arrangement of the transport element, which in particular has at least one blocking element, for example a pawl, relative to the stack located in the input device based on the captured size of the stack and/or the captured density of the stack such that the time point of the drawing of the value document from the stack is changed. In particular, the control device is devised to open and/or close the at least one blocking element relative to a time point at which a frictional force occurs between the value document to be drawn and the transport device, so that the time duration of the motion of the value document on the transport path can be adjusted. Thereby the occurrence of disturbances in the singler can be reliably avoided, in particular a jam of value documents, and faulty drawings, in which no value document is drawn.

In particular, the control device is devised to open the blocking element at an early time point with regard to the occurrence of a frictional force between the value document to be drawn and the transport device if the density of the value documents located in the stack is low, i.e. the state of the value documents is poor. Thereby the time period is prolonged during which the frictional force acting between the value document to be drawn and the transport device effects a drawing of the lowest value document in the stack. Correspondingly, the control device is devised to open the blocking element at a later time point with regard to the occurrence of a frictional force between the value document to be drawn and the transport device if the density of the value documents located in the stack is high, i.e. the state of the value documents is good. Thereby the time period is reduced during which the frictional force acting between the value document to be drawn and the transport device effects a drawing of the lowest value document in the stack. The adjusting of the time duration in dependence on the density of the stack of value documents prevents the occurrence of singler disturbances and faulty drawings particularly reliably.

In a further preferred embodiment the control device is devised to control the arrangement of the transport element relative to the transport device, in particular to the drawing element, based on the captured size of the stack and/or the captured density of the stack such that the frictional forces occurring between the transport device and the value document to be drawn are changed. In particular, the transport element can be configured as an retaining element. In a further embodiment, frictional force occurring between the transport device and the value document to be drawn can be adjusted by the distance of the retaining element or parts of the retaining element to the transport device. A precise adjustment of the distance makes the singling operation particularly reliable.

Preferably the retaining element has at least one retaining runner. Further preferably, the transport element, in particular a friction band or a friction wheel, has at least one groove, in which the at least one retaining runner of the retaining element can engage, in particular in a form-locking manner. If a value document is located between the at least one retaining runner and the at least one groove and the at least one retaining runner is introduced into the at least one groove, the value document is deformed and is urged particularly reliably against the transport element, that is, the frictional force between the value document and the transport element is reliably increased. The control device is preferably devised to control the introducing of the at least one retaining runner into the at least one groove in dependence on the density and/or the size of the stack.

In a further preferred embodiment, at least one sensor has at least two measurement electrodes and is arranged in the input device in such a way that at least a part of the value documents located in the stack forms a dielectric which can influence the electrical capacity of the at least two measurement electrodes. In this connection, the control device is devised to establish the size of the stack and/or the density of the stack on the basis of the electrical capacity of the at least two measurement electrodes. For example, at least two measurement electrodes can be arranged mutually opposingly, so that the stack or a part of the stack lies between them. Preferably, the at least two measurement electrodes can, however, also be arranged in a plane, in particular side by side or in an integrated form, in which one measurement electrode encloses or surrounds another measurement electrode. An electric voltage is applied to the measurement electrodes. Field lines of the electrical field generated thereby between the at least two measurement electrodes then penetrate the value documents of the stack located in the region of the measurement electrodes, so that the capacity of the at least two measurement electrodes—in relation to a situation in which no value documents are located in the region of the measurement electrodes—is increased. The size and/or the density of the stack can thereby be determined particularly simply and reliably.

In a further preferred embodiment the measurement electrodes are arranged substantially vertically in the input device and the control device is devised to establish the size of the stack and/or the density of the stack of value documents on the basis of the electrical capacity of at the least one measurement electrode which is located at the height of an upper end of the stack. In particular, the sensor is subdivided into several measuring regions by a vertical arrangement of more than two measurement electrodes. The size and/or the density of the stack can thereby be established in a particularly simple and robust way.

Preferably, the control device is devised to determine the number of measurement electrodes on the basis of the capacity of the vertically arranged measurement electrodes whose capacity has or exceeds a pre-specified value, i.e. whose surface is completely covered by value documents or in front of whose entire surface value documents are stacked. On the basis of this number, the size, in particular the height, of the stack can be reliably determined. Optionally, another height of a topmost stack section can be added to the height of the stack established in this way, which can be estimated on the basis of the capacity of the uppermost measurement electrode which is covered, where applicable, only partly with value documents.

BRIEF DESCRIPTION OF THE DRAWINGS

Further advantages, features and application possibilities of the present invention will result from the subsequent description in connection with the figures. There are shown.

DETAILED DESCRIPTION OF VARIOUS EMBODIMENTS

Figure 1:
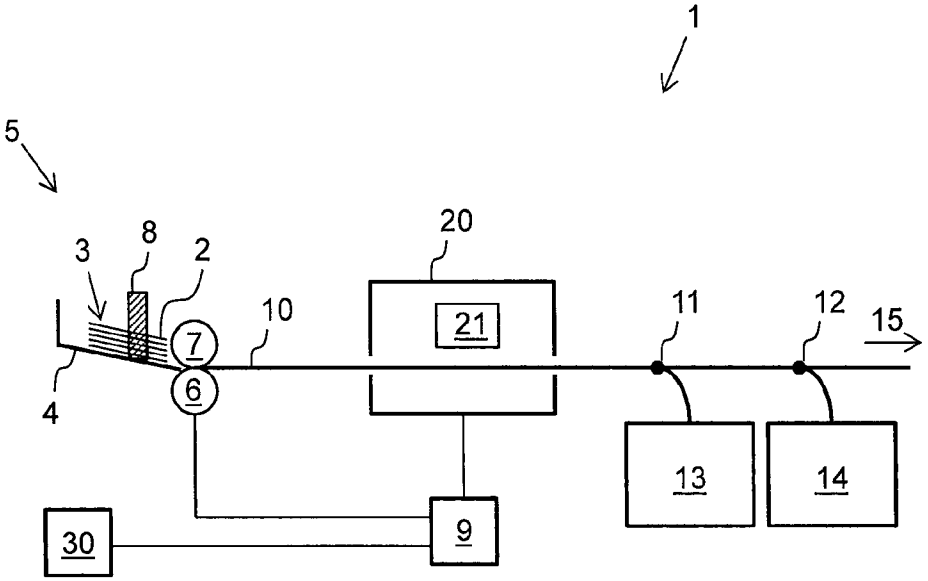
FIG. 1 an example of a value-document processing system.

FIG. 1 shows a schematic representation of an example of a value-document processing system 1 having an apparatus 5 for singling value documents 2, in particular bank notes. The value documents 2 are inputted in the form of a stack 3 into an input device 4 and are singled by an interaction of a schematically indicated transport device 6 and a likewise schematically represented transport element 7, i.e. are drawn individually from the stack 3.

A transport apparatus 10 transfers the singled value documents 2 to a checking apparatus 20 in which the value documents 2 are checked with regard to their properties, such as for example denomination and/or state and/or authenticity. For this purpose check sensors 21 are provided which capture physical properties of the value documents 2 and convert them into corresponding sensor signals which are evaluated in a control device 9.

The control device 9 is further devised to control gates 11, 12 such that the processed value documents 2 in dependence on their established property are transferred into a first or second container 13 or 14. In this connection, for example, value documents 2 in a good state (fit) are deposited in the first container 13 and value documents 2 in a poor state (unfit) in the second container 14. Depending on the case of application, the value documents 2 can be deposited in the different containers 13, 14, for example also in dependence of their denomination. Further gates and further containers (not represented) or further processing elements can also be provided, such as a shredder for destroying value documents 2 having certain properties, which is indicated by an arrow 15.

In the region of the input device 4, a sensor 8 is provided which is configured to capture the stacks 3 of value documents 2 located in the input device 4 and to generate corresponding sensor signals on the basis of which in the control device 9 a measure can be derived of the size and/or the density and/or the weight of the stack 3 and/or the state of the value documents 2 located in the stack 3. The size of the stack 3 can be in particular the height of the stack 3 and/or a fill level of the input device 4 relating to a maximum possible fill level.

The control device 9 is further devised to control the transport device 6 and/or the transport element 7 in dependence on the sensor signals of the sensor 8 and/or the properties of the stack 3 or the value documents 2 located therein established from the sensor signals. Thereby a high singling quality is achievable, wherein in particular the occurrence of jams or faulty or multiple drawings is reliably prevented.

Alternatively or additionally, the control device 9 can also be devised to carry out the control of the apparatus 5, in particular of the transport device 6 and/or the transport element 7, in dependence on user inputs which are inputted by a user in an input unit 30. Such user inputs can be, for example, the singling speed of the apparatus 5 and/or the processing speed in the checking apparatus 20. Further, it can be provided that properties of the value documents 2 are established on the basis of sensor data of the check sensors 21 taking into account the user inputs. In this connection a user input can relate to, e.g., the denomination of the value documents 2 present in the stack 3 and/or their states and/or the number of the value documents 2 in the stack 3, as far as known. These properties then need not necessarily be established on the basis of sensor data of the sensor 8 and/or the check sensors 21.

Hereinafter, the control of the transport device 6 and/or the transport element 7 in dependence on the properties of the stack 3, in particular size, density and/or weight, or the value documents 2 contained in the stack 3, in particular their state, is explained in more detail in connection with the FIGS. 2 and 3.

Figure 2:
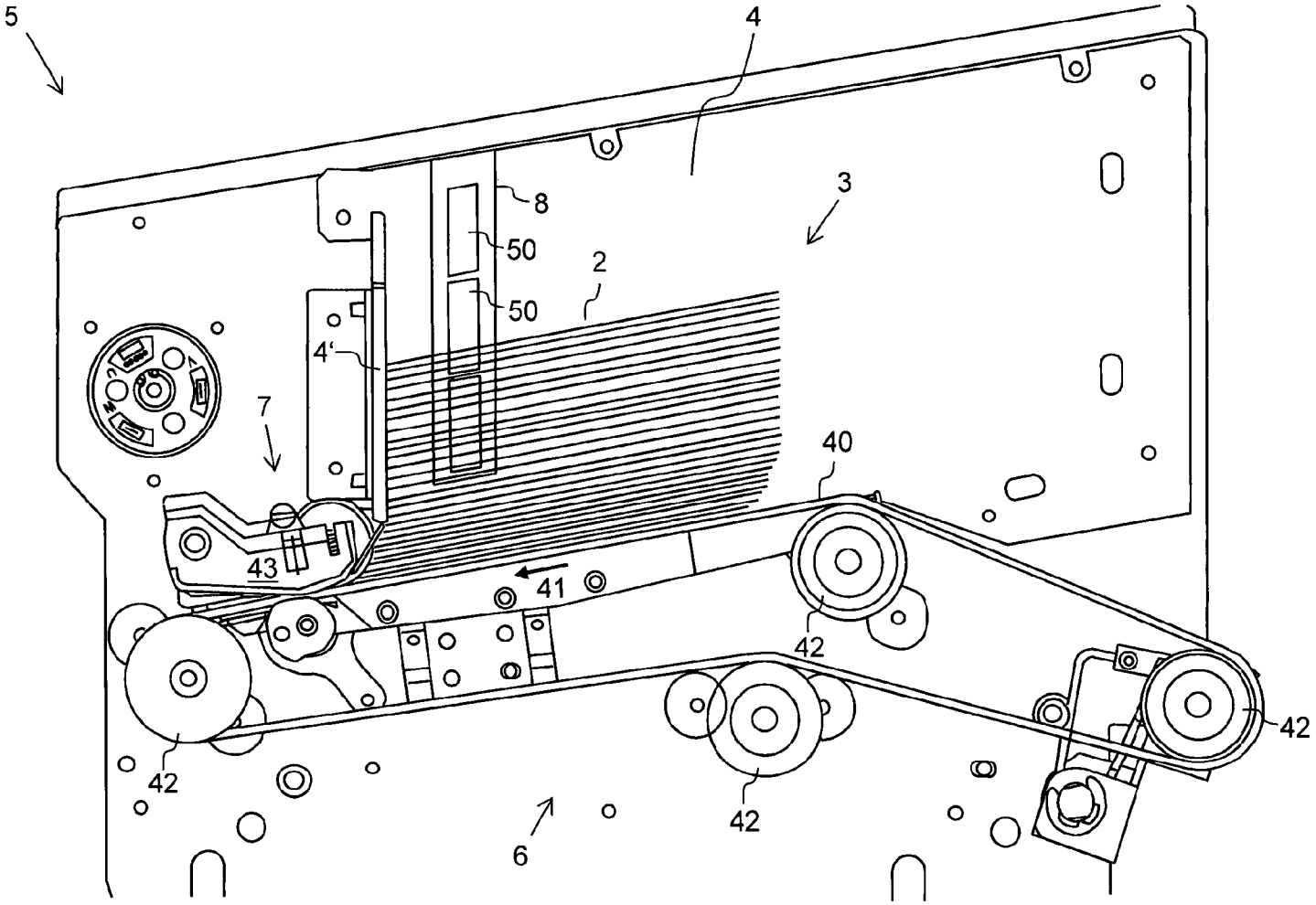
FIG. 2 an example of an apparatus for singling value documents.

FIG. 2 shows an example of an apparatus 5 for singling value documents 2 having an input device 4, a transport device 6, a transport element 7 and a sensor 8.

The input device 4 is configured such that a stack 3 of value documents 2 can be inserted and received. In the process, the lowermost value document 2 of the stack 3 lies at least partly on top of a supporting surface (not represented). In the represented example, the lowermost value document 2 of the stack 3 lies also on the transport device 6, at least partly. The input device 4 further has a stop 4' at which the value documents 2 of the stack 3 can be aligned.

The individual value documents 2 in the stack 3 lie in different density, as represented schematically in FIG. 2. In particular the value documents 2 in the lower region of the stack 3 are urged more densely against each other by the weight of the value documents 2 lying above them than the upper value documents 2. The density of the stack 3 is thus higher in the lower region than in the upper region.

In the represented example, the transport device 6 has a friction band 40 which can transport a value document 2 lying on top the friction band 40 along a transport path 41. By a friction force acting between the lowest value document 2 of stack 3 and the friction band 40, the lowermost value document 2 of stack 3 is reliably drawn during the transport movement along transport path 41. In the process, the stop 4' of the input device 4 reliably prevents that the stack 3 of value documents 2 likewise moves along the transport path 41.

Preferably the friction band 40 is configured as an endless band which is guided via several deflection rollers 42 of which at least one is connected to a drive unit, for example an electric motor.

The singling operation is influenced by a transport element 7 which in the present example has a retaining element 43. The retaining element 43 is devised to fan out the stack 3 of value documents 2, in particular in a lower region, i.e. in a region near the friction band 40. Preferably, the transport device 6, in particular the friction band 40, is arranged relative to the transport element 7, in particular to the retaining element 43, and/or relative to the stack 3 in such a way that the frictional forces between the lowermost value document 2 of the stack 3 and the friction band 40 in the region near the transport element 7 are particularly large, i.e. increased. By fanning out the stack 3, the increased frictional force acts mainly on the lowermost value document 2 of the stack 3, so that this is drawn particularly reliably from the stack 3.

The sensor 8 has several measuring regions 50 and is arranged vertically in the input device 4, so that the measuring regions 50 are hidden to different parts of the stack 3 of value documents 2. Preferably the measuring regions 50 are arranged or configured in such a way that about 300 value documents 2 can be arranged or stacked before a measuring region 50, i.e. that about 300 value documents 2 stacked before a measuring region 50 can cover this completely. However, in principle it is possible to configure the measuring regions 50 larger or also smaller.

The sensor 8 is devised to capture the size of the stack 3 and the density of the stack 3. For this purpose, it can be established, for example on the basis of the generated sensor signals, how many or which measuring regions 50 are covered by the stack 3 and/or how many value documents 2 at the upper end of the stack 3 cover one of the upper measuring regions 50 at least partly.

Figure 3A:
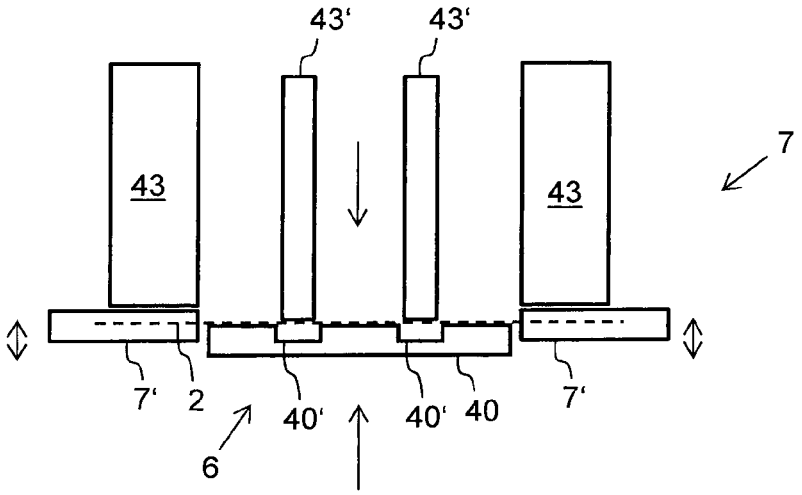
FIGS. 3*a*) and 3*b*) examples of a transport device and a transport element in different phases a) and b) of a singling operation.
Figure 3B:
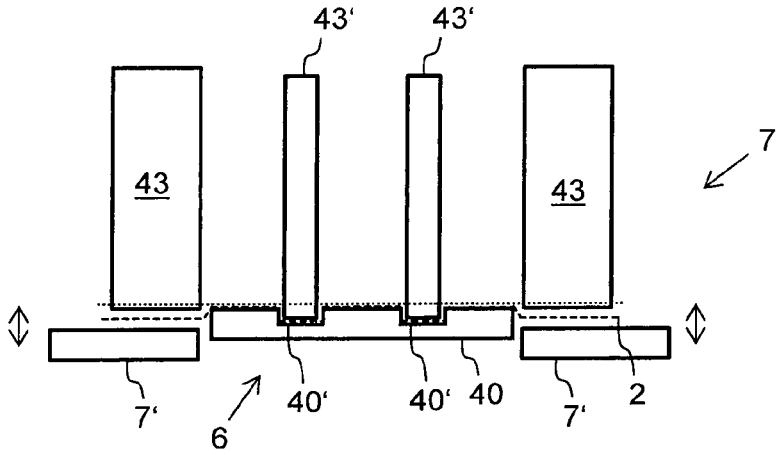

FIGS. 3*a*) and 3*b*) show schematically an example of an arrangement of a transport device 6 and a transport element 7 in a cross-sectional representation in different phases of a singling operation. The transport device 6 has a friction band 40 having two grooves 40', and the transport element 7 has a retaining element 43 having two retaining runners 43'. Furthermore, the transport element 7 has two blocking elements 7' which in the represented example are displaceable parallel to the image plane, indicated by the double arrows. In particular, the two blocking elements 7' are thereby moveable out of the transport path 41 (see FIG. 2), which in the represented example is directed out of the image plane. In the phase shown in FIG. 3*a*), the two blocking elements 7' are in a blocking position, so that a value document 2, represented as a dashed line, cannot be drawn from the stack 3 in spite of frictional force between the value document 2 and the friction band 40 and a motion of the friction band 40 along the transport path 41 (see FIG. 2).

The friction band 40 is upwardly displaceable (see lower arrow), so that the frictional force between the value document 2 and the friction band 40 is increased. In particular, the friction band 40 can be displaced in such that the retaining runners 43' engage in the grooves 40' and therefore the frictional force is increased particularly distinctly.

Alternatively or additionally, the retaining elements 43, in particular the retaining runners 43', are downwardly displaceable (see upper arrow). This is represented schematically in the phase shown in FIG. 3*b*). By the displacement of the retaining element 43, in particular the retaining runners 43', the retaining runners 43' engage in the grooves 40' of the friction band 40 and in the process deform the value document 2 according to the shown dashed line, so that this is urged against the friction band 40 by which the frictional force between the value document 2 and the friction band 40 is increased. For comparison, the position of the value document 2 in the not-displaced state of the retaining elements 43 (i.e. the position of the value document from FIG. 3*a*) is drawn as a dotted line.

To open the transport path 41 (see FIG. 2) for the value document 2 to be drawn, the blocking elements 7' can be moved or pulled out of the transport path 41. Alternatively to the opening of the blocking elements 7' by a moving out of the transport path 41 represented in FIG. 3*b*), it can also be advantageous to rotate or tilt the blocking elements 7' around an axis, in particular an axis parallel or perpendicularly to the friction band 40, out of the transport path 41.

As already specified above, the size and density of the stack and, where applicable, properties derived therefrom of the stack or the value documents contained in the stack are captured or established with the help of the sensor signals of the sensor 8 (see FIGS. 1 and 2). The transport device 6 and/or the transport element 7 are controlled depending on the captured or established properties. In this connection, in particular the arrangement of transport device 6 and transport element 7 relative to each other and/or relative to the stack is controlled.

If, for example, a large or high stack having value documents is located in the input device, the frictional force between the lowermost value document 2 of the stack and the friction band 40 can be increased by displacing the friction band 40 and/or the retaining element 43, 43' in such a way that the value document 2 is drawn reliably from the stack in spite of relatively high normal force of the stack onto the value document 2. In case of a low stack, the friction band 40 and/or the retaining element 43, 43' can be displaced such that the frictional force between the lowermost value document 2 of the stack and the friction band 40 is reduced.

Alternatively or additionally, the time point of moving out the two blocking elements 7' from the transport path can be also controlled depending on the established density of the stack or the state of the contained value documents. This time point can be adjusted in particular also relative to the time of the displacing of the friction band 40 and/or the retaining runners 43' or relative to the time of the engaging of the retaining runners 43' in the grooves 40' of the friction band 40. As a result of this, the time duration during which the frictional force between the value document 2 and the friction band 40 is large enough and leads to a drawing of the value document 2 from the stack can be influenced advantageously.

For example, upon a high density of the stack, e.g. upon fit value documents 2, a relatively late time point of the moving out of the blocking elements 7' can be adjusted and thus a relative short feed movement during the singling operation, i.e. the blocking elements 7' open relatively late or are moved out of the transport path later. In contrast, upon a low density of the stack, e.g. upon unfit value documents 2, a relatively early time point of the moving out of the blocking elements 7' can be adjusted and thus a longer feed movement during the singling operation, i.e. the blocking elements 7' open relatively early or are moved out of the transport path earlier.

Overall, the occurrence of disturbances, such as paper-of-value jams or faulty drawings, is reliably avoided by the control of the singling operation, described hereinabove only by way of example, in dependence on the captured or established properties of the stack or the value documents.

Figure 4:
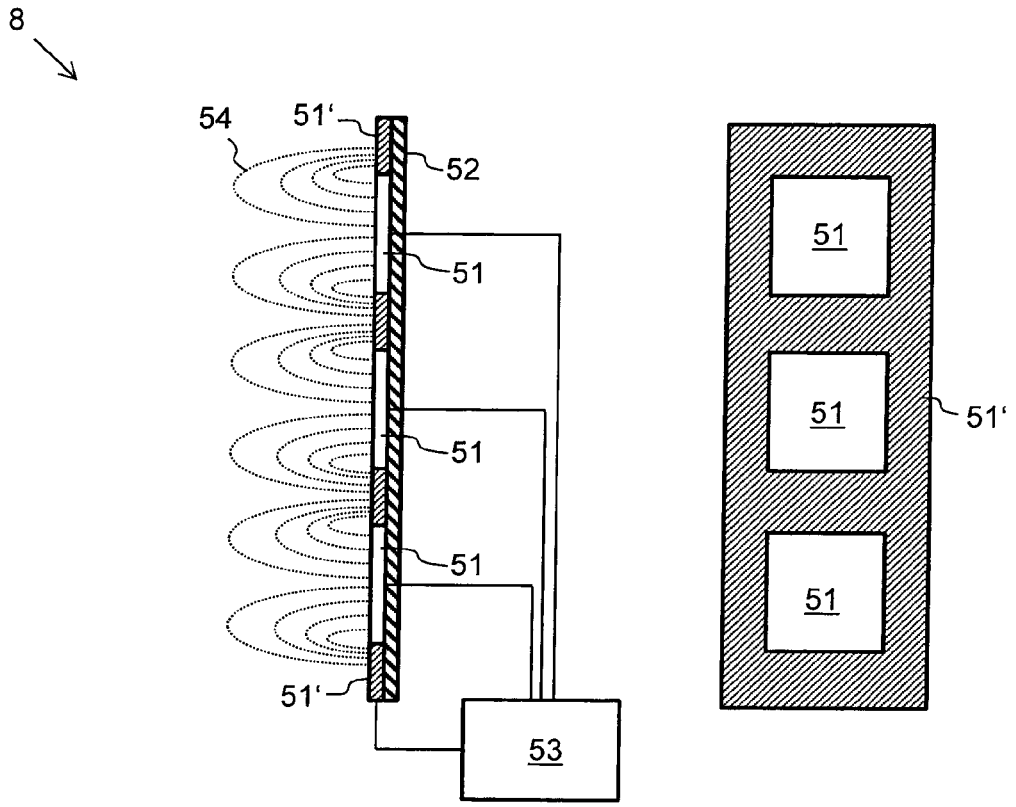
FIG. 4 an example of a sensor having several measurement electrodes.

FIG. 4 shows an example of a sensor 8 having four measurement electrodes 51, 51', namely three first measurement electrodes 51 and a second measurement electrode 51'. The right section of FIG. 4 shows a schematic frontal view of the sensor 8 in an integrated embodiment of the sensor 8 in which the first measurement electrodes 51 and the second measurement electrode 51' are arranged in one plane, wherein the second measurement electrode 51' is electrically isolated from the first measurement electrodes and surrounds the first measurement electrodes 51.

The left part of the FIG. 4 shows a schematic cross section of a side view of the sensor 8. The measurement electrodes 51, 51' are mounted on a carrier 52 or substrate. A control element 53, which can be a part of the control device 9 (see FIG. 1), is configured to bring the first measurement electrodes 51, on the one hand, and the second measurement electrode 51', on the other hand, to different potentials by applying a voltage, so that the first measuring electrodes 51 in relation to the second measuring electrode 51' act like a capacitor having an electrical capacitance. The electrical field lines 54 formed in the process are indicated by dotted lines.

The sensor 8 is arranged in the input device 4 (see FIG. 2) in such a way that electrical field lines 54 forming between the measurement electrodes at a higher potential and the measurement electrodes at a lower potential, penetrate the value documents 2 stacked in the input device 4. The value documents 2 thereby act as a dielectric with a dielectric constant $\varepsilon_r$, whereby the capacity of the respective measurement electrode pairs 51, 51' changes depending on whether and how many value documents 2 are located in the region of the first measurement electrodes 51.

Preferably the control element 53 can establish the respective capacity of the first measurement electrodes 51 and the second measurement electrode 51'. Thereby each of the first measurement electrodes 51 corresponds to a measuring region 50 represented in FIG. 2. From the number of the measurement electrodes 51, which have a certain capacity on account of the value documents 2 located before them, the size, i.e. the height, of the stack can be established. From the capacity established in each case, a measure for the density of the stack in the region of the respective measurement electrode 51 can be established.

Each of the measurement electrodes 51 can define a measuring region 50 (see e.g. FIG. 2).

The invention claimed is:

1. An apparatus for singling value documents, in particular bank notes, having:

an input device which is devised for receiving a stack of value documents, a transport device which is devised for drawing a value document from a stack of value documents located in the input device, a transport element which is devised to influence the drawing of the value document from the stack of value documents, at least one sensor which is devised to capture a size of the stack located in the input device, in particular a height of the stack and/or a fill level and a density of the stack, and a control device which is devised to control the transport device and/or the transport element based on the captured size of the stack and/or the captured density of the stack;

wherein the control device is devised to control the arrangement of the transport element, having at least one blocking element, relative to the stack located in the input device based on the captured size of the stack and/or the captured density of the stack such that a time point of a drawing of the value document from the stack is changed.

2. The apparatus according to claim 1, wherein the control device is devised to establish a weight of the stack on the basis of the size and the density of the stack and to control the transport device and/or the transport element based on the established weight of the stack.

3. The apparatus according to claim 1, wherein the control device is devised to establish the state of value documents located in the input device on the basis of the density of the stack and to control the transport device and/or the transport element based on the established state of the value documents.

4. The apparatus according to claim 1, wherein the transport device has at least one drawing element which is devised to draw the value document from the stack, and the control device is devised to control the arrangement of the drawing element relative to the stack located in the input device based on the captured size of the stack and/or the captured density of the stack in such a way that the frictional forces occurring between the drawing element and the value document to be drawn are changed.

5. The apparatus according to claim 4, wherein the at least one drawing element is configured as a friction band, friction wheel or air baffle plate.

6. The apparatus according to claim 1, wherein the control device is devised to control the arrangement of the transport element relative to the transport device based on the captured size of the stack and/or the captured density of the stack such that the frictional forces occurring between the transport device and the value document to be drawn are changed.

7. The apparatus according to claim 1, wherein the at least one sensor has at least two measurement electrodes and is arranged such that at least one part of the value documents located in the stack forms a dielectric which influences the electrical capacity of the at least two measurement electrodes and wherein the control device is devised to establish the size of the stack and/or the density of the stack on the basis of the electrical capacity of the at least two measurement electrodes.

8. The apparatus according to claim 7, wherein the measurement electrodes are arranged substantially vertically in the input device and the control device is devised to establish the size of the stack and/or the density of the stack of value documents on the basis of the electrical capacity of at the least one measurement electrode which is located at the height of an upper end of the stack.

9. A value-document processing system for processing, sorting, counting and/or checking value documents having an apparatus for singling value documents according to claim 1.

* * * * *